US006145778A

United States Patent [19]

Tuominen et al.

[11] Patent Number: 6,145,778

[45] Date of Patent: Nov. 14, 2000

[54] REEL-UP AND METHOD OF CONTROLLING NIP LOAD THEREIN

[75] Inventors: Olli Matti Tuominen, Valkkin; Vesa Markkanen, Kirkkonummi; Raimo Pesonen, Vantaa; Kauko Pätäri, Valkeakoski, all of Finland; Tommy Göran Andersson; Lars-Erik Roland Önnerlöv, both of Karlstad, Sweden

[73] Assignee: Valmet-Karlstad AB, Karlstad, Sweden

[21] Appl. No.: 09/270,171

[22] Filed: Mar. 16, 1999

Related U.S. Application Data

[60] Provisional application No. 60/081,325, Apr. 10, 1998.

[30] Foreign Application Priority Data

Mar. 16, 1998 [SE] Sweden ..... 9800838-6
Feb. 12, 1999 [SE] Sweden ..... 9900460-8

[51] Int. Cl.[7] ..... B65H 18/14; B65H 19/22

[52] U.S. Cl. ..... 242/541.7; 242/542.3; 242/533.3

[58] Field of Search ..... 242/541.7, 542.3, 242/533.3

[56] References Cited

U.S. PATENT DOCUMENTS 3,614,011 10/1971 Karr .
4,390,138 6/1983 Rohde et al. .
4,428,543 1/1984 Kuhn .
4,634,068 1/1987 Malkki et al. .

FOREIGN PATENT DOCUMENTS 0 244 059 A2 11/1987 European Pat. Off. .
2 188 619 10/1987 United Kingdom .
WO97/47547 12/1997 WIPO .

*Primary Examiner*—John Q. Nguyen
*Attorney, Agent, or Firm*—Alston & Bird LLP

[57] ABSTRACT

A reel-up for reeling a paper web onto reeling drums (2), comprising stand parts (5) with rails (9), along which the reeling drums (2), rotatably carried by their bearing housings (4), are displaced, a surface winding drum, over which the paper web runs and which is rotatably journalled in bearing housings (13) on the stand parts, a secondary system, and a primary system, having primary arms (24) with gripping members (33) for retaining a reeling drum (2), which primary arms have actuators (28) for moving the reeling drum (2) along the envelope surface of the surface winding drum. Each primary gripping member has outer and inner locking arms (34, 35), pivotably journalled about a common journalling shaft (36) on the primary arm, a first actuator (44), carried by the gripping member to open and close the same by pivoting the outer locking arm (34) about the journalling shaft (36) in relation to the inner locking arm so as, in the open position, to receive the reeling drum and, in the closed position, retain the same in its bearing housings (4), and a second actuator (45), mounted between the primary arm and the inner locking arm (35). The outer and inner locking arms and the first actuator constitute a pivotable unit for regulating the linear load.

20 Claims, 7 Drawing Sheets

REEL-UP AND METHOD OF CONTROLLING NIP LOAD THEREIN

CROSS-REFERENCE TO RELATED APPLICATION

This application claims the benefit of U.S. Provisional Patent Application Ser. No. 60/081,325 filed Apr. 10, 1998.

FIELD OF THE INVENTION

The present invention relates to a reel-up in a paper machine for reeling a paper web, onto reeling drums to form paper reels.

BACKGROUND OF THE INVENTION

For reeling paper reels it is common to use two systems to maintain continuous production in the reel-up, namely a primary system, having a pair of pivotable primary arms with gripping devices to receive an empty reeling drum, and a secondary system, which receives the reeling drum from the primary system once an initial number of turns of the paper web have been wound onto the reeling drum. The secondary system usually has either a pair of secondary arms or a pair of secondary carriages, which, as the diameter of the paper reel increases, are pivoted or linearly displaced, depending on the case, along a pair of mutually parallel stand members, on which a driven surface winding drum is rotatably arranged, over which the paper web runs. The primary arms place the reeling drum to abut the surface winding drum to initiate reeling of the web. Thereafter, the primary arms convey the reeling drum along the surface winding drum down to two rails, along which the reeling drum, rotatably carried by its bearing housings, is displaced during the continued reeling of the web. It is important that a certain linear load is maintained against the surface winding drum and that the paper reel, during its growing, is evenly reeled without creases and folds arising in the layers, especially the inner layers, which otherwise must be discarded. The linear load varies throughout the reeling-up operation in magnitude as well as direction and depends mainly on the three variables applied load, weight increase of the growing paper reel, and current location of the paper reel along the envelope surface of the surface winding drum. The location relative to the surface winding drum causes the linear load to vary, as the paper reel is pressed against the envelope surface along a contact line, which is shifted downwards in an arc-shaped movement along the envelope surface, whereby a horizontal as well as a vertical force component arises, the magnitudes of which vary mutually throughout the entire movement. The linear load is affected negatively also during the transfer of the reeling drum from the primary system to the secondary system, as an exchange must take place between the separate gripping members of the two systems and, with central drive, between two separate drive means as well, whereby a temporary increase in pressure arises. To optimize the reeling-up operation, the linear load must be kept within carefully determined maximum and minimum values throughout the entire reeling-up process. To reduce the negative effects of the described variations in the linear load between the growing paper reel and the surface winding drum, arrangements with cam steerings and/or power cylinders by the primary arms to regulate the linear load in the nip have been tested. Thus, U.S. Pat. No. 3,614,011 describes a reel-up with two primary arms, which each have a loading device outside the reeling drum to regulate the applied load, which loading device comprises a power cylinder and a holding hook displaceable along the primary arm by means of the power cylinder. Each loading device co-operates with an unloading device, comprising a lower, manoeuvrable cam track, arranged at each end of the surface winding drum of the reel-up. The reeling drum is supported on the cam tracks and conveyed along the curved surfaces of the same down to a pair of rails, where two secondary arms assume control of the paper reel. Each cam track is pivotable about a shaft by means of a power cylinder to be able to regulate the linear load to some extent while the paper reel is growing against the surface winding drum. The linear load in the nip is thus regulated by the power cylinders of the loading devices, through the displacement of the locking hooks, as well as by the power cylinders of the unloading devices, through the adjustment of the cam tracks. U.S. Pat. No. 4,634,068 describes a reel-up, in which it is sought to control the variation of the linear load. Each primary arm comprises a loading device with a power cylinder, which controls an upper locking hook displaceable along the primary arm, and an unloading device, arranged at the primary arm and having a lower support with an unloading cylinder, arranged to relieve the nip of the increasing weight of the paper reel. In the known reel-ups described above, the control of the linear load must be performed by two completely separate, but yet necessarily mutually co-operating, devices, of which the loading device alone regulates the applied load, while the unloading device regulates the unloading of the weight of the reeling drum and the increasing weight of the growing paper reel. This makes it very difficult to control the linear load in an optimal way. A further problem with both these known reel-ups is that their primary arms have gripping devices with fixed or substantially fixed lower holders for the reeling drum. The diameter of the paper reel can thus only be permitted to increase to a certain pre-determined maximum limit before the paper reel lifts the reeling drum from said lower holders. To be able to reel more paper onto the reeling drum while it is still held by the primary arms, the displaceable upper locking hook and the fixed lower holder or cam track have, in some reel-ups, been replaced by a gripping device with two pivotable gripping parts, consisting of an upper locking hook and a lower support arm, both being journalled to the primary arm about separate pivoting shafts. As the diameter of the paper reel increases, the locking hook and support arm are pivoted out from the envelope surface of the surface winding drum. The reeling drum is thereby undesirably rotated within the gripping device, which rotation is caused by the locking hook and support arm being displaced in parallel relative to the surface winding drum whilst simultaneously being pivoted about their respective pivoting shafts, journalled a distance from each other.

SUMMARY OF THE INVENTION

The object of the present invention is to provide an improved reel-up, which reduces the problems discussed above, at least to a considerable extent.

The reel-up, in accordance with a preferred embodiment of the invention, is characterized in that each gripping member of the primary system comprises

- an outer locking arm, pivotably journalled about a journalling shaft on the upper mounting part of the primary arm,
- an inner locking arm, pivotably journalled about the same journalling shaft as the outer locking arm,
- a first actuator, carried by the gripping member and arranged to open and close the gripping member by pivoting the outer locking arm about the journalling shaft in relation to the inner locking arm so as, in the open position, to receive the reeling drum and, in the closed position, retain the same at its bearing housing, a second actuator, pivotably mounted to and extending between the inner locking arm and the upper mounting part of the primary arm, in which configuration the outer locking arm, the inner locking arm and the first actuator constitute a pivotable unit arranged, when influenced by the second actuator, to be pivoted about the journalling shaft to regulate the linear load between the paper reel growing on the reeling drum and the support means.

The reel-up, in accordance with the invention, has a primary system, which provides considerably improved control of the linear load between the surface winding drum and the growing paper reel, which means that the linear load can be regulated with greater precision than previously possible. Through the invention, it is possible to lock the actuator controlling the locking arms, so that it locks or fixes the gripping device in a locked position whilst maintaining the power applied for locking. The function can be simply described as a "frozen" condition. This means that a possible leakage in the supply pipes to the actuator does not prejudice the fixed, locked position of the locking arms retaining the reeling drum. Improved safety is achieved in that there is no risk of the reeling drum falling out of the gripping device under the influence of its own weight in the event of the above-mentioned fault arising.

Additionally, a very safe transition can be achieved between the primary system and the secondary system so that the linear load can be maintained within the prescribed range even during this transition.

BRIEF DESCRIPTION OF THE DRAWINGS

The invention is further described with reference to the accompanying drawings.

DETAILED DESCRIPTION OF THE DRAWINGS

Figure 1:
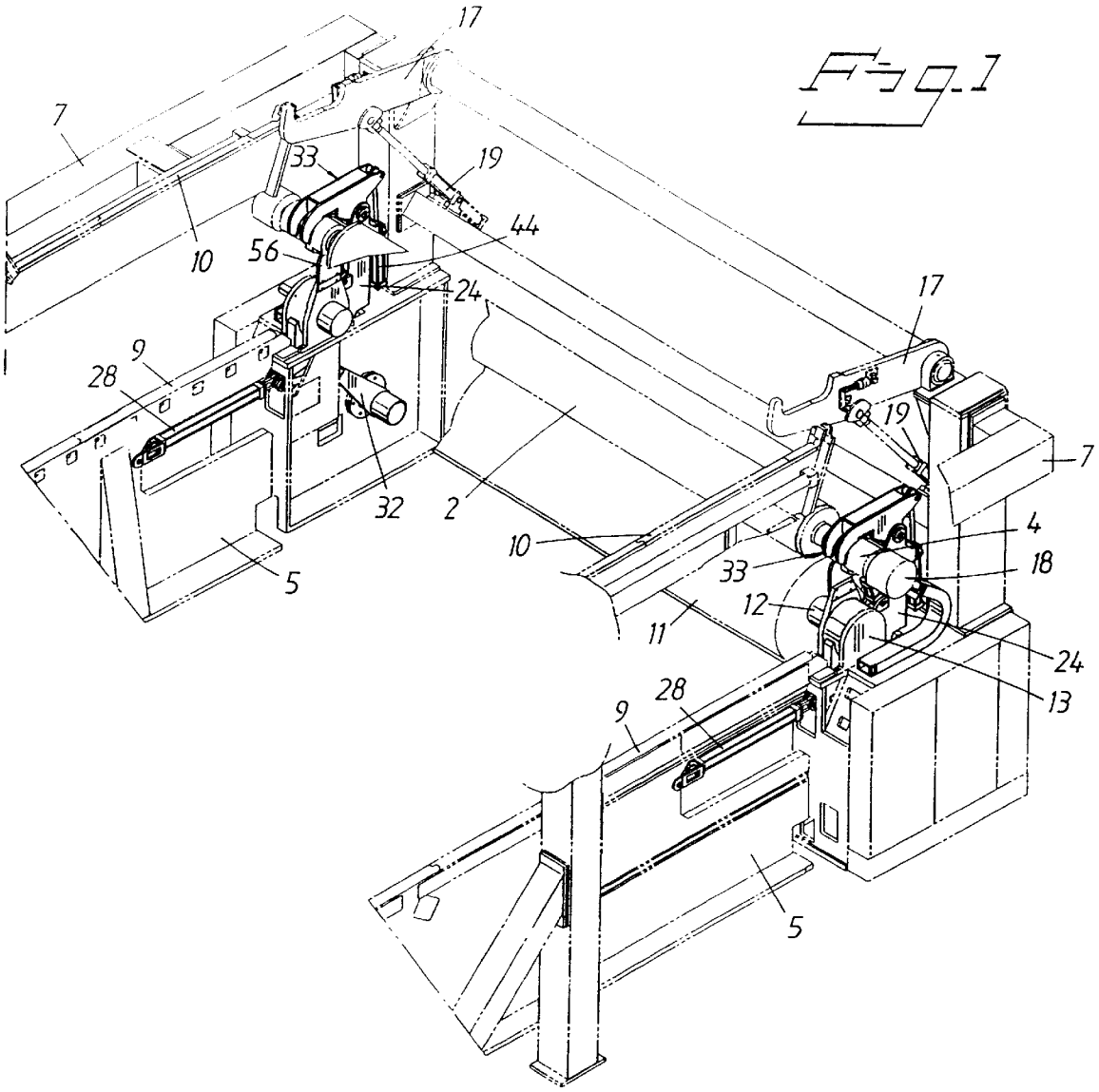
FIG. 1 is a perspective view of the upstream part of a reel-up with a primary system in accordance with the invention.
Figure 2:
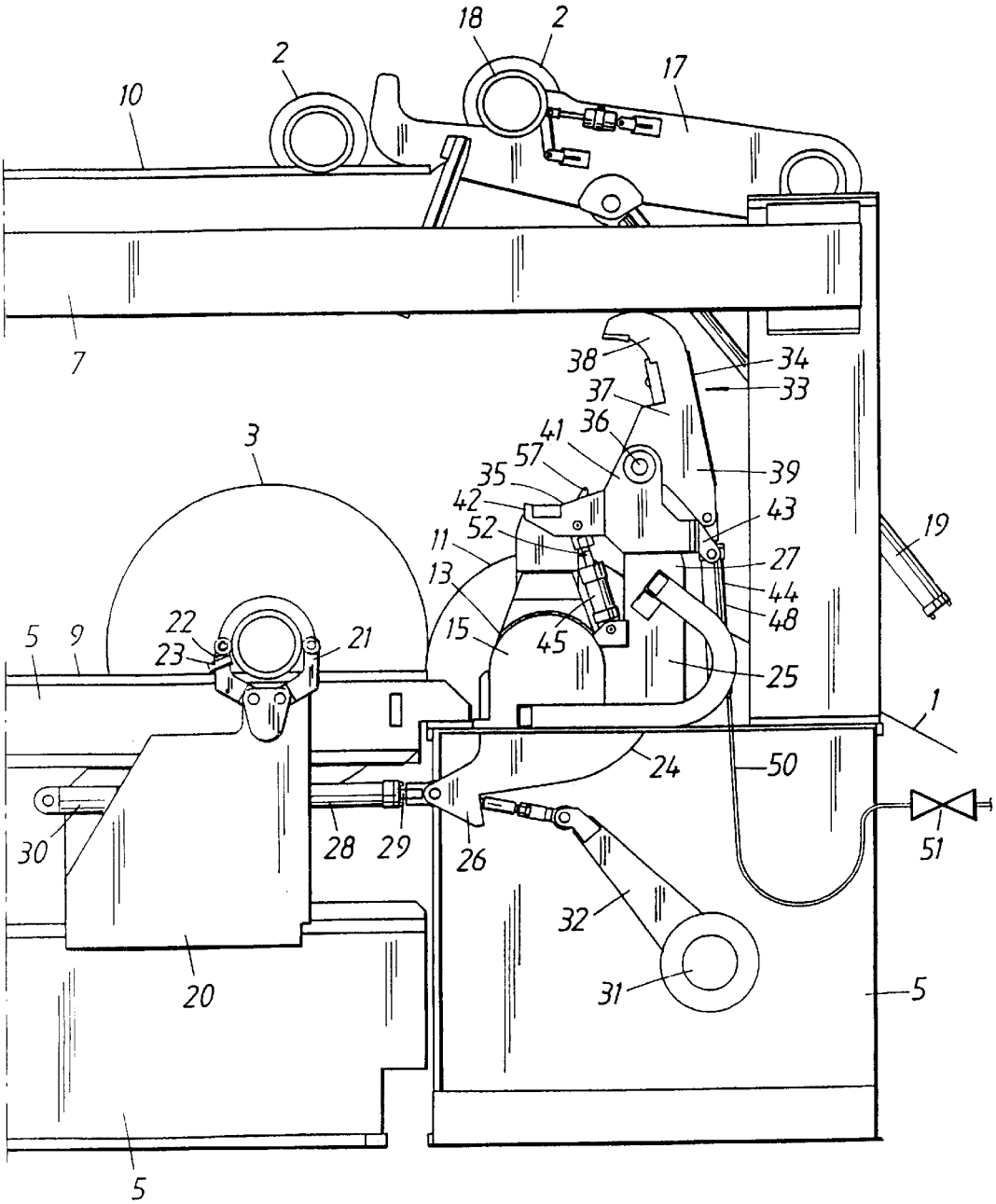
FIG. 2 is a side view of the reel-up in accordance with FIG. 1 and shows schematically one of the primary arms of the primary system with a gripping member in accordance with the invention in an open top position and with a paper reel being reeled in a secondary carriage.
Figure 3:
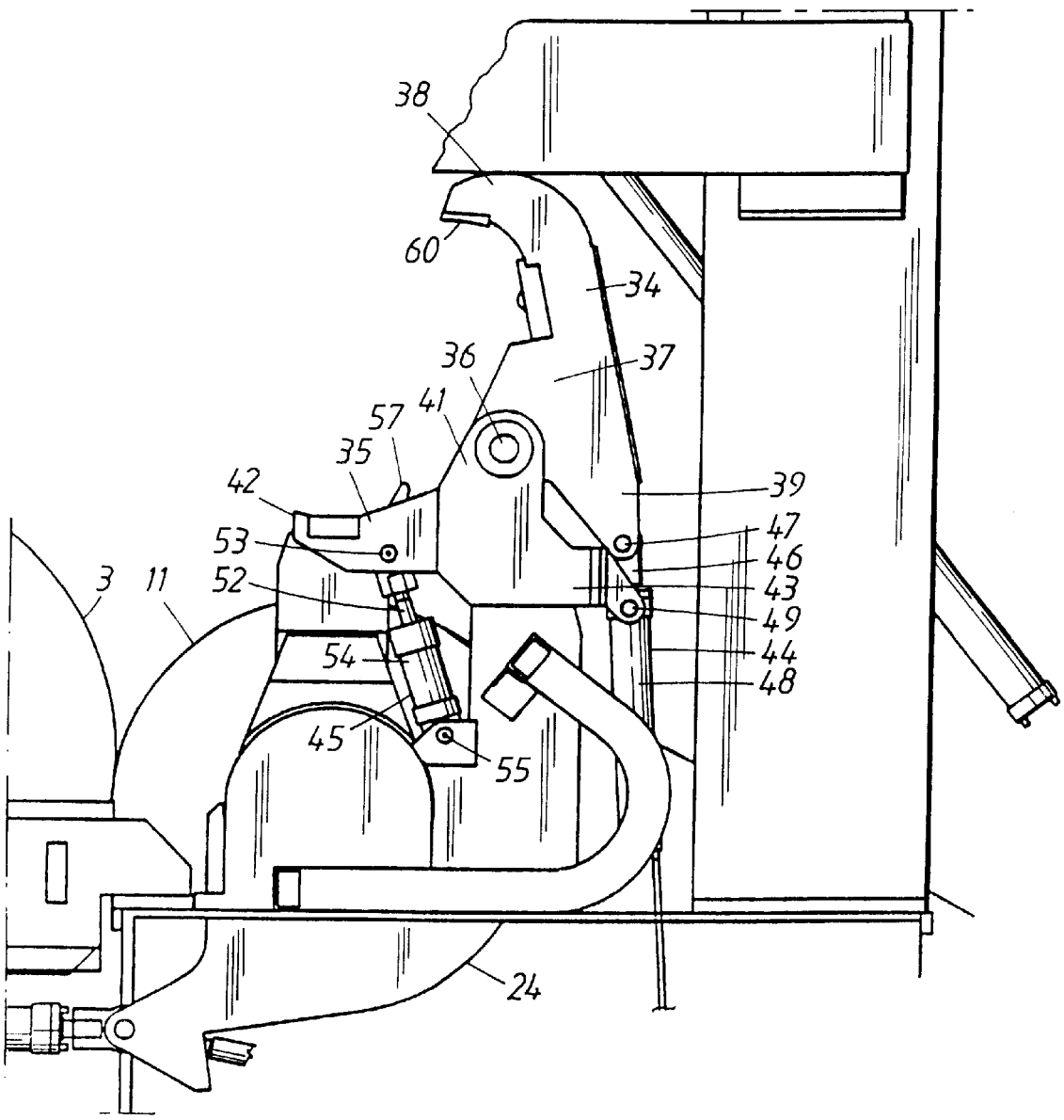
FIG. 3 is an enlargement of the gripping member in FIG. 2.

In FIG. 1, the upstream part of a reel-up in a paper machine, in which paper is manufactured in a continuous web, is shown a perspective view. The web 1 is reeled in the reel-up, as shown in FIG. 2, on a rotatable reeling drum 2 to form a paper reel. The reeling drum 2 has a bearing housing 4 arranged axially inside a braking drum 18 at each end, which bearing housing 4 is provided with a peripheral, surrounding groove 40, see FIG. 7. The braking drum 18 is usually provided with an axial coupling device.

The reel-up comprises a machine-stand with two lower, longitudinally extending stand parts 5 and two upper, longitudinally extending stand parts 7. Rails 9, 10 are horizontally, rigidly mounted to these stand parts to support the reeling drums 2, which, carried in their bearing housings 4, roll along the rails 9, 10, the latter being received in the grooves 40 of the bearing housings 4.

A support means in the shape of a surface winding drum 11 extends between the lower stand parts 5 and has shaft pins 12 for rotatable journalling of the surface winding drum 11 in bearing housings 13, mounted on the lower stand parts 5. The paper web 1 runs about the envelope surface of the surface winding drum 11, and a drive device (not shown) is arranged to rotate the surface winding drum 11 with a peripheral speed that corresponds to the speed of the paper web 1. It will be understood that the distance between the rails 9 of the lower stand parts 5 is somewhat greater than the width of the web. As is apparent from FIG. 7, each bearing housing 13 has inner and outer end walls 14, 15 and a tubular, rotationally symmetrical casing 16, which is concentric with the shaft pin 12 and pivotably journalled in the bearing housing 13. Thus, the axis of pivot of the casing 16 coincides with the axis of rotation of the surface winding drum 11.

The rails 10 of the upper stand parts 7 are arranged to support a stock of reeling drums 2.

Figure 4:
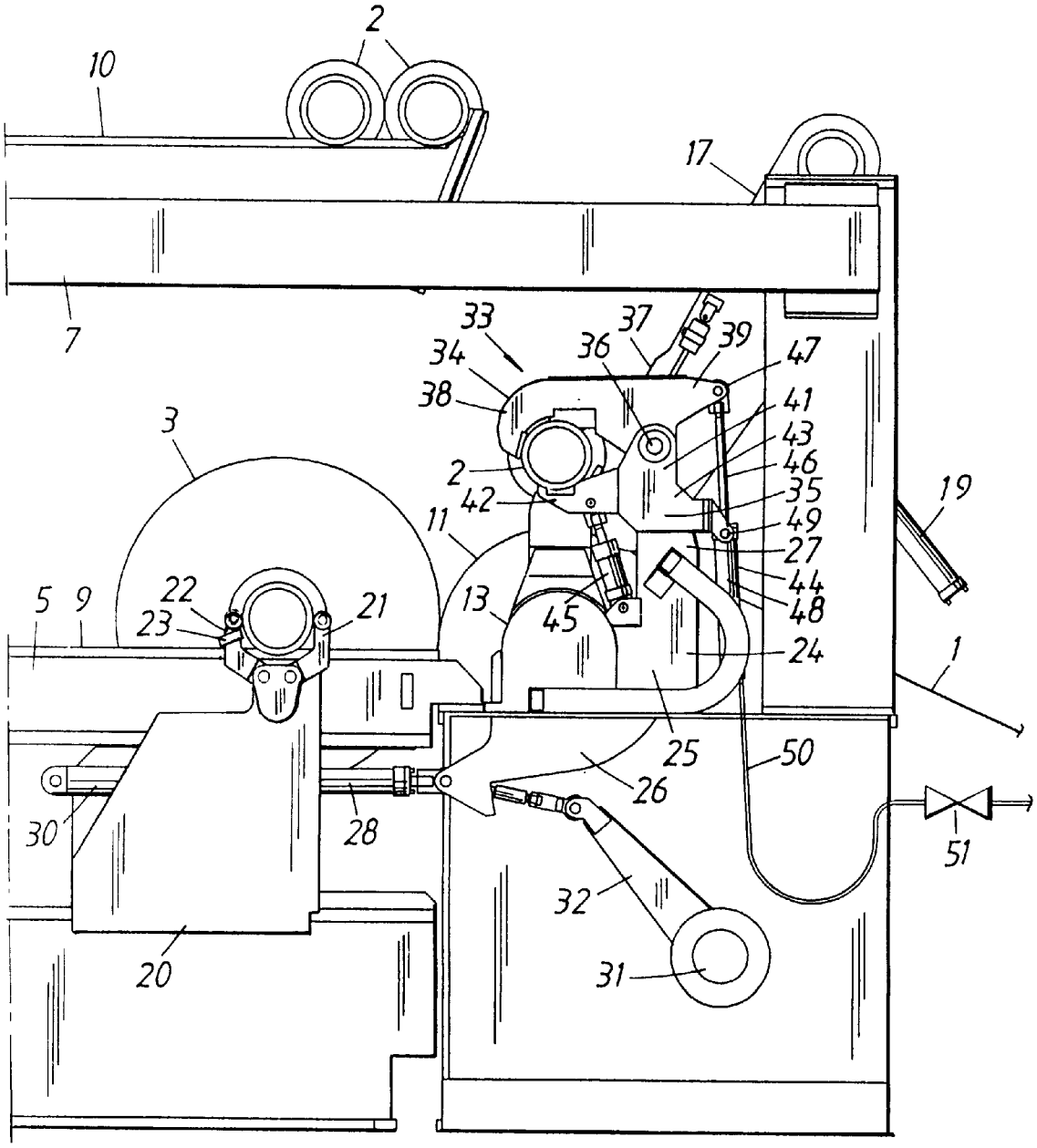
FIG. 4 shows the reel-up in accordance with FIG. 2 with a new reeling drum being held by the closed gripping member with the primary arm in its top position.

The reel-up comprises two lowering arms 17, pivotably journalled on the machine-stand to be pivoted, by means of hydraulic cylinders 19, between an upper collecting position, see FIG. 2, and a lower delivering position, see FIG. 4.

The reel-up comprises a primary system and a secondary system to provide continuous reeling of the paper web 1 is on a reeling drum 2.

The secondary system has two secondary carriages 20, each journalled to a respective lower stand part 5, to be linearly moved along the stand parts 5. A hydraulic cylinder (not shown) is attached to each secondary carriage 20 and stand part 5 for reciprocating movement of the secondary carriage 20 along the stand part 5 in a controlled manner. The movements of the secondary carriages 20 are synchronized with each other. Each secondary carriage 20 has a gripping member, which comprises a locking arm 21 and a press arm 22 and is arranged to receive a reeling drum 2 with a commenced paper reel 3 and to remove the same when the paper reel is completed and, further to be closed around the bearing housings of the same to guide the reeling drum 2 along the rails 9 whilst maintaining the requisite linear load between the growing paper reel 3 and the surface winding drum 11. The locking and press arms 21, 22 are pivotably journalled on the secondary carriages 20 and manipulated by hydraulic cylinders (not shown), comprised in the control system of the reel-up for control of the reeling-up process. The free ends of the locking and press arms 21, 22 carry small, rotatably journalled pulleys for co-operation with the bearing housings 4 of the reeling drum so that these are free to roll along the rails 9. The reference number 23 denotes a position indicator of inductive type in the control system provided on each press arm 22 to detect a stop position for the respective secondary carriage 20, as the latter must stop, during the returning movement, a certain distance before the press arm 22 contacts the bearing housing 4 of the reeling drum 2, see FIG. 6.

The primary system comprises two primary arms 24, pivotably journalled to pivot about the axis of rotation of the surface winding drum 11 in that the primary arms 24 are rigidly mounted, by welding, for instance, to the tubular, pivotably journalled casings 16 of the bearing housings 13 of the surface winding drum 11. Each primary arm 24 has a waist part 25, by means of which the primary arm 24 is rigidly connected to the respective bearing housing 13 of the surface winding drum 11, a lower mounting part 26 and an upper mounting part 27, which two mounting parts 26, 27 are located on either side of the axis of rotation of the surface winding drum 11. A hydraulic cylinder 28 is, via its piston-rod 29, pivotably mounted to the lower mounting part 26 of the primary arm 24 and, via the end of its cylinder 30, pivotably mounted to the respective lower stand part 5. A horizontal synchronization shaft 31 extends between and through the lower stand parts 5, on which it is pivotably journalled. Two connecting arms 32 are rigidly connected to the synchronization shaft 31 at both its ends and are pivotably connected to the primary arms 24 at their lower mounting parts 26. The movements of the primary arms 24 about their axis of pivot are thus synchronized with each other.

Each primary arm 24 comprises a tongs-like gripping member 33, comprising a first, outer locking arm 34 and a second, inner locking arm 35. The expression "outer" and "inner" refer to positions in relation to each other and to the surface winding drum 11. The outer locking arm 34 is pivotably journalled on the upper mounting part 27 of the primary arm 24 by means of a horizontal journalling shaft 36. The inner locking arm 35 is pivotably journalled on the same journalling shaft 36 as the outer locking arm 34. The outer locking arm 34 comprises a waist part 37, with which it is pivotably journalled on said journalling shaft 36, a free gripping part 38 for contacting the reeling drum 2 and a mounting part 39. In the embodiment shown, the gripping part 38 is in the shape of a hook, which in the locked position surrounds the bearing housing 4 of the reeling drum 2 with a certain sector angle, for instance about 90°. The hook 38 and the mounting part 39 are located on either side of said journalling shaft 36. The inner locking arm 35, likewise, comprises a waist part 41, with which it is pivotably journalled on said common journalling shaft 36, a free gripping part 42 for contacting the reeling drum 2 and a mounting part 43. The free gripping part 42, which acts as a counter-support for the reeling drum 2 and the hook 38 in its locked position, and the mounting part 43 are located on either side of said common journalling shaft 36.

The gripping member 33 of the primary arm 24 comprises a first double-acting hydraulic cylinder 44 and a second double-acting hydraulic cylinder 45. The first hydraulic cylinder 44 is, via its piston-rod 46, pivotably mounted to the mounting part 39 of the outer locking arm 34 by means of a shaft pin 47 and, via its cylinder 48, at the end of the cylinder 48 facing the piston-rod 46, pivotably mounted to the mounting part 43 of the inner locking arm 35 by means of two opposite shaft pins 49. A symbolically indicated, flexible pipe 50 for supplying hydraulic oil to and evacuating it from said first hydraulic cylinder 44 is provided with a valve 51, which in practice is mounted on the hydraulic cylinder 44, for disconnecting said supply when the hydraulic cylinder is in a certain protruding position. The first hydraulic cylinder 44 extends freely with its cylinder 48 upstream of and along the upper mounting part 27 of the primary arm 24, i.e. it has solely mechanical, pivotable contact with the inner locking arm 35, which thus carries the hydraulic cylinder 44.

Said second hydraulic cylinder 45 is, via its piston-rod 52, pivotably mounted to the gripping part 42 of the inner locking arm 35 by means of a shaft pin 53, located at a pre-determined distance from the journalling shaft 36 of the gripping member, i.e. the common journalling shaft of the locking arms 34, 35, and, via its cylinder 54, at its end facing away from the piston-rod 52, pivotably mounted to the upper mounting part 27 of the primary arm 24 by means of a shaft pin 55. On the inside, the hook 38 of the outer locking arm 34 has a surface 60 that is inwardly-curved or angled towards the drum-contacting gripping part 42 of the inner locking arm 35 in such a way that the distance between the free ends of the locking arms 34, 35 facing each other, when the gripping member 33 is in its active, locked position, is smaller than the diameter of the bearing housing 4 of the reeling drum 2 so that the reeling drum 2 is retained by the gripping member 33, even when it is facing downwards with its said free ends.

The inner end wall 14 of each bearing housing 13 is extended upwards to carry a support 56 with an upper surface for receiving the reeling drum from the lowering arms 17, with the supports 56 being positioned inside the grooves 40 of the bearing housings 4. Each support 56 has a rearward stop 57, arranged to prevent the reeling drum 2 from rolling backwards when delivered. The supports 56 are located at such a level above the surface winding drum 11 that they carry the entire weight of the reeling drum 2 without loading the inner locking arms 35 and their hydraulic cylinders 45, although the locking arms 34, 35 are in contact with the bearing housings 4 of the reeling drum during this concluding phase of the lowering operation.

In the embodiment shown, the outer locking arm 34 of each gripping member 33 is constructed out of two parallel plates 58, arranged a certain distance from each other for co-operation with the bearing housings 4 of the reeling drum 2 on either side of its groove 40. The plates 58 are held rigidly in position by means of an intermediate part 59.

In the closed, locked position of the gripping member 33, when its locking arms 34, 35 surround the bearing housings 4 of the reeling drum 2 and the valve 51 is in the closed position so that the piston-rod 46 cannot be returned into the cylinder 48, the two locking arms 34, 35 of the gripping member 33 form a pivotable unit, which is pivotable about the journalling shaft 36 by means of the second hydraulic cylinder 45, which thus forms part of the system for controlling the linear load between the initially growing paper reel 3 and the surface winding drum 11. The pivotable unit also includes the first hydraulic cylinder 44.

The reel-up described above operates substantially as follows.

Figure 5:
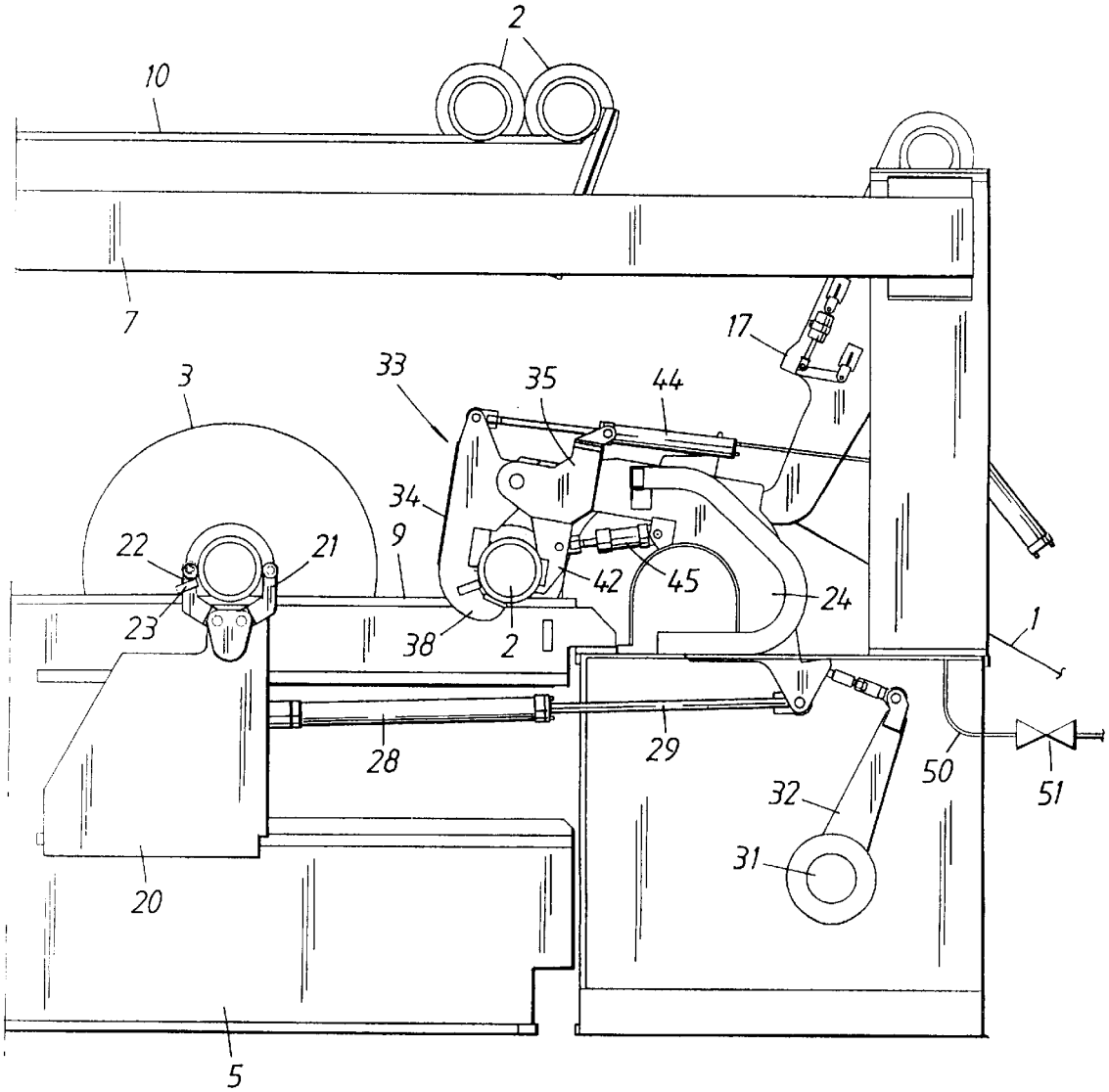
FIG. 5 shows the reel-up in accordance with FIG. 2 with a completed paper reel in the secondary carriage and with a commenced paper reel in the primary arm in its rail position.
Figure 7:
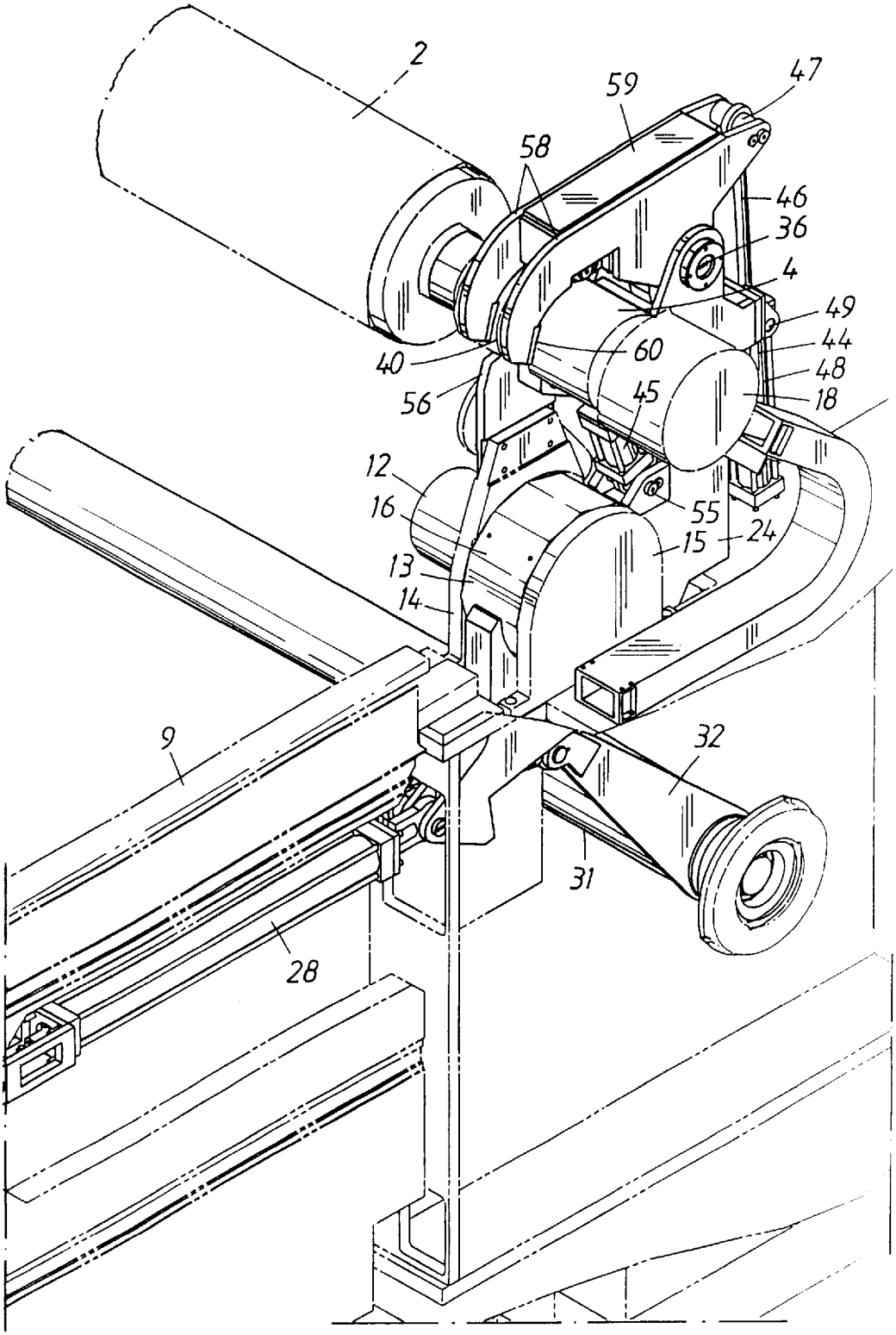
FIG. 7 is an enlarged perspective view of one of the primary arms in the reel-up in accordance with FIG. 1.

In the phase of a reeling-up process in progress shown in FIG. 2, the primary arms 24 are in their top positions and their gripping members 33 are in their open positions for receiving an empty reeling drum 2, which is collected by the lowering arms 17 and placed on the two supports 56, see FIG. 7, whereupon the first hydraulic cylinders 44 are activated to pivot the outer locking arms 34 downwards to abut the bearing housings 4 of the reeling drum 2 so that said bearing housings are securely clamped between the outer and inner locking arms 34, 35, as shown in FIG. 4. When the gripping members 33 are in their closed position, the valves 51 are activated so that the oil supply pipes 50 are closed and the outer and inner locking arms 34, 35 are fixed in relation to each other by each piston-rod 46 being held securely locked in its protruding position. As the first hydraulic cylinders 44 lack mechanical connection with any structural element other than the gripping members 33, each gripping member 33 and its hydraulic cylinder 44 form a pivotable unit, pivotable about the journalling shaft 36 by activation of the second hydraulic cylinder 45. In the phase of the reeling-up process shown in FIG. 4, a paper reel 3 has been completed in the secondary system. The empty reeling drum 2 in the primary system is caused to rotate by means of said starting device not shown. The hydraulic cylinders 28 of the primary arms 24 are activated to pivot the primary arms 24 to the rail position, as shown in FIG. 5. During this pivoting movement, the reeling drum 2, at this stage already rotating, is moved to abut the surface winding drum 11, whereby the paper web 1 is brought into contact with the reeling drum 2 for wrapping and initiation of the reeling up. The paper web 1 is torn and the secondary carriages 20 are activated to transport the completed paper reel 3 away from the surface winding drum 11, as also shown in FIG. 5. The reeling drum 2, held by the gripping members 33 of the primary arms 24, meets the surface winding drum 11 at a pre-determined initial angle position and a pre-determined linear load is set with the assistance of the control system of the reel-up via the second hydraulic cylinders 45. The weight of the reeling drum 2 and the turns of the paper web 1 wound onto it have an effect on the linear load, from maximum influence in said initial angle position to no influence at all in the rail position in accordance with FIG. 5. To maintain the pre-determined linear load, the second hydraulic cylinders 45 will initially unload the surface winding drum 11 from the influence of part of the weight of the reeling drum 2, which unloading effect gradually diminishes as said influence diminishes. At a given angle position, depending on the value of the pre-determined linear load, the hydraulic cylinders 45 switch from a controlled, unloading function to a controlled, loading function, so that the reeling drum 2 will press against the surface winding drum 11 with gradually increasing force, depending on the angle position, to maintain the pre-determined linear load. The inner hydraulic cylinder 45 also compensates for the continuous increase in diameter of the paper reel 3, which occurs while the reeling drum 2 is pivoted down to the rail position by the primary arms 24, by synchronously pivoting the two units and the reeling drum 2 held by said units, although still rotatable, so that the distance between the axis of rotation of the reeling drum 2 and the axis of rotation of the surface winding drum 11 increases.

The angle positions of the primary arms 24 relative to a defined starting position are suitably sensed by a position detector in one of the hydraulic cylinders 28 of the primary arms 24. After recalculation, this provides a more precise value for the angle position than an angle indicator which measures the angle position of the primary arm directly during its pivoting movement.

As the weight of the reeling drum 2 is known and does not vary significantly from one to another, the control system of the reel-up can be pre-programmed with a curve chart relating to the value of the vertical force component as a function of the angle position in relation to the surface winding drum 11.

Figure 6:
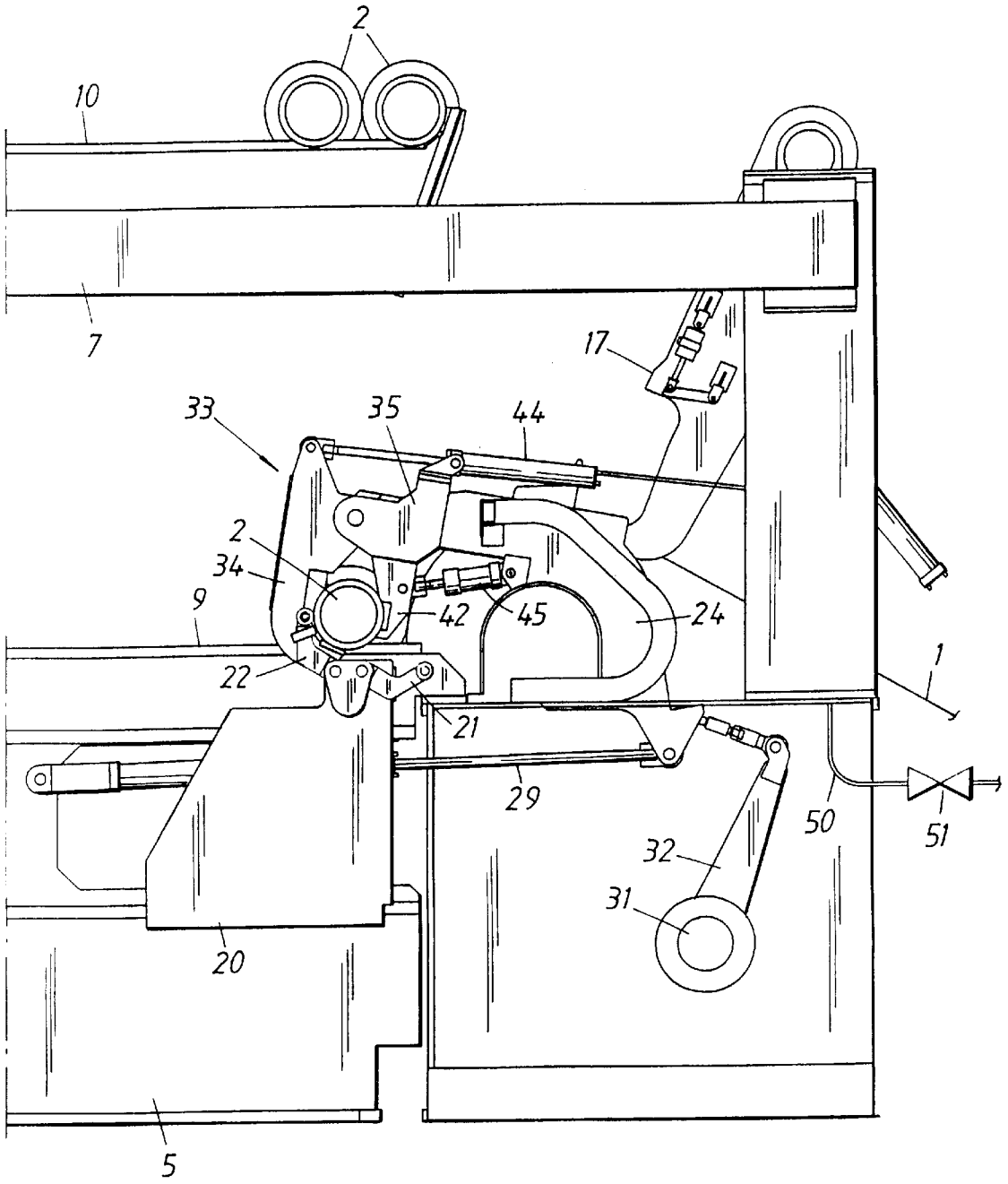
FIG. 6 shows the reel-up in accordance with FIG. 2 with the closed gripping member in the rail position, a reeling drum with a commenced paper reel being transferred to a secondary carriage.

When the secondary carriages 20 have delivered the completed paper reel 3 at the downstream end of the reel-up, they revert to their starting positions in proximity to the surface winding drum 11 to receive and retain the next reeling drum 2 with their gripping members 21, 22, shortly after the phase shown in FIG. 6.

As the gripping members 33 of the primary arms 24 retain the reeling drum 2 in its two bearing housings 4, the latter cannot rotate. Consequently, the bearing housings 4 cannot, in their locked position, be brought into direct contact with the rails 9, if friction is to be avoided. The downward pivoting movement of the primary arms 24 must therefore be halted before the bearing housings 4 contact the rails 9. Such a halt occurs when the distance between each bearing housing 4 and rail 9 is one or a few millimeters. The hooks 38 of the outer locking arms 34 encompass the bearing housings 4 from below when the gripping members 33 are in the rail position, which means that the hooks 38 carry a substantial part of the weight of the reeling drum 2 in this rail position. The reeling-up process continues with a controlled linear load when the primary arms 24 are in this position until the secondary carriages 20 take control of the reeling-up operation. The returning movement of the secondary carriages 20 towards the surface winding drum 11 is halted by the position indicators 23 a certain distance before the press arms 22 of the secondary carriages 20 reach the bearing housings 4, thus preventing an instantaneous increase in the linear load, more precisely a doubling, which would occur if the gripping members of the secondary carriages 20 were to continue in the direction towards the bearing housings 4 to take control of the linear load directly. By halting the secondary carriages 20 in the manner described, the paper reel 3 is allowed to "grow into" the system for control of the linear load of the secondary carriages 20, i.e. the diameter of the paper reel 3 continues to increase whilst the linear load is controlled by the primary system until the bearing housings 4 of the reeling drum 2 with the growing paper reel 3 meet the press arms 22 of the secondary system, as illustrated in FIG. 6. A smooth transition from the primary to the secondary loading system is thus achieved. The inner surfaces of the hooks 38, which surfaces contact the bearing housings, are angled and incline obliquely downwards, towards the rails 9, and, when the gripping members 33 are opened by the valves 51 being opened and the first hydraulic cylinders 44 activated, the reeling drum 2 is lowered relatively slowly towards the rails 9, in that the bearing housings 4 follow the tilted surfaces 60 of the hooks 38 in a vertical movement, correspondingly slow relative to the opening movement of the outer locking arms 34. In this way, a desirable gentle lowering of the reeling drum 2 onto the rails 9 is achieved. At this stage, the locking arms 21 are turned up into their locked positions against the bearing housings 4, while, simultaneously, control of the linear load ceases in respect of the primary system and is taken over by the secondary system.

The second hydraulic cylinders 45 are of a low-friction type to achieve the greatest possible sensibility in the control of the linear load.

Secondary arms can be used instead of secondary carriages 20.

Pneumatic cylinders or, if possible, other types of actuators, can be substituted for the hydraulic cylinders described above, if so desired.

Apart from the indicators 23, indicators are arranged in a plurality of other locations in the reel-up to detect different positions for other movable structural elements to obtain data for controlling the reeling-up process during desired phases.

In the preferred embodiment described above and shown on the accompanying drawings, the axis of pivot of the primary arms 24 is co-axial with the axis of rotation of the surface winding drum 11. If so desired, however, the axis of pivot of the primary arms can be eccentrically arranged in relation to the axis of rotation of the surface winding drum. The gripping part 38 of the outer locking arm 34 is shaped as a hook, while the contact surface of the gripping part 42 of the inner locking arm 35 has a more straight or slightly inwardly-curved shape. Although this embodiment is preferred, it is possible to reverse the locking arms 34, 35 with reference to their free gripping parts 38, 42 or to shape both gripping parts as hooks or the like, for instance hooks with the same enclosing arc of the bearing housings 4, but a somewhat smaller enclosing arc for each of them than in the hook 38 shown.

The invention can also be applied to a reel-up, the secondary system of which has at least one secondary unit with two secondary bodies that are journalled on the stand parts for linear movement and have lifting devices for lifting the reeling drum up from the stand rails and supporting the reeling drum during the reeling-up of the paper web. The invention can further be applied to a reel-up with twin secondary units lacking the above-mentioned lifting devices.

In the embodiment shown, the support means consists of a surface winding drum. In an alternative embodiment (not shown), the support means consists of a belt or of a combination of surface winding drum and belt.

What is claimed is:

1. A reel-up for reeling a paper web onto reeling drums to form paper reels, comprising:

a support frame including a pair of spaced lower rails for supporting opposite ends of a reeling drum;

a driven surface winding device defining an outer surface that supports the paper web and is driven to carry the paper web therewith along a predetermined path;

a pair of spaced-apart primary arms having upper portions configured to receive and support opposite ends of a reeling drum delivered into the primary arms such that a paper-supporting portion of the reeling drum is rotatable about an axis of the reeling drum, the primary arms at lower portions thereof being rotatably journaled on the support frame about a common axis such that pivotal movement of the primary arms carries the reeling drum toward and into contact with the outer surface of the surface winding device at an upper position thereof so that reeling of the paper web onto the reeling drum is initiated, and then carries the reeling drum generally downward along the outer surface to a lower position adjacent the lower rails;

outer and inner locking arms pivotally mounted on the upper portion of each primary arm so as to be pivotally movable away from and toward each other for respectively opening to receive the reeling drum and closing to grip and retain the reeling drum, each pair of outer and inner locking arms being pivotal about a common gripping unit axis on the respective primary arm so as to form a gripping unit that is pivotable about said gripping unit axis;

a first actuator coupled with each gripping unit, each first actuator being arranged to pivot one of the locking arms relative to the other for opening and closing the gripping unit; and a second actuator coupled between each gripping unit and the respective primary arm, each second actuator being arranged to pivot the gripping unit relative to the primary arm about the gripping unit axis so as to control a linear nip load between a paper reel being formed on the reeling drum and the surface winding device as the primary arms carry the reeling drum from the upper position to the lower position along the outer surface of the surface winding device.

2. The reel-up of claim 1, wherein the first actuators are operable to lock the outer locking arms in fixed positions relative to the inner locking arms after being closed to grip and retain the reeling drum.

3. The reel-up of claim 2, wherein the first actuators comprise extendable and retractable power cylinders supplied with pressurized fluid, the first actuators including valve members movable between open positions for supplying pressurized fluid to the power cylinders and closed positions for interrupting supply of pressurized fluid to the power cylinders so as to lock the power cylinders at fixed lengths.

4. The reel-up of claim 1, wherein the gripping units are arranged such that when the primary arms are in positions placing the reeling drum in the lower position adjacent the lower rails, at least one of the locking arms of each gripping unit has a drum-engaging surface supporting at least part of the weight of the reeling drum and the paper reel formed thereon.

5. The reel-up of claim 4, wherein said drum-engaging surface comprises a generally hook-shaped portion of the locking arm formed at a free end thereof.

6. The reel-up of claim 5, wherein said hook-shaped portion is formed at the free end of the outer locking arm.

7. The reel-up of claim 1, further comprising:

a pair of upper rails supported by the support frame above the primary arms and arranged to support a store of empty reeling drums thereon.

8. The reel-up of claim 7, further comprising:

a pair of lowering arms mounted on the support frame and operable to retrieve a reeling drum from the store and lower the reeling drum into the open gripping units of the primary arms.

9. The reel-up of claim 8, further comprising:

a pair of secondary units movably supported in the support frame on the lower rails, the secondary units being operable to receive the reeling drum from the primary arms and to continue reeling of paper onto the reeling drum.

10. The reel-up of claim 9, wherein the secondary units are movable so as to carry the reeling drum along the lower rails toward and away from the surface winding device.

11. The reel-up of claim 10, wherein the secondary units comprise carriages translatable on the support frame toward and away from the surface winding device, the secondary units further including gripping arms pivotally mounted on the carriages, and actuators coupled with the gripping arms for pivotally moving the gripping arms to grip the reeling drum and to urge the paper reel on the reeling drum into contact with the surface winding device.

12. The reel-up of claim 1, wherein the surface winding device comprises a rotatably driven winding drum.

13. The reel-up of claim 12, wherein the primary arms are mounted so as to be pivotal about an axis parallel to a rotation axis of the winding drum.

14. The reel-up of claim 13, wherein the pivot axis of the primary arms coincides with the rotation axis of the winding drum.

15. A method for reeling a paper web onto a reeling drum to form a paper reel and for controlling nip load between the paper reel and a surface winding device having an outer surface that is driven to transport a paper web thereon, the method comprising:

carrying the reeling drum in a pair of spaced-apart primary arms and moving the primary arms relative to the surface winding device so as to move the reeling drum into an upper position so as to make contact with the paper web on the surface winding device and thereby initiate winding of the paper web onto the reeling drum;

moving the primary arms to carry the reeling drum from the upper position generally downward along the outer surface of the surface winding device to a lower position, so as to form a growing paper reel on the reeling drum;

supporting the reeling drum during the movement of the primary arms by gripping opposite ends of the reeling drum in a pair of gripping units that are respectively mounted on the primary arms so as to be pivotable relative thereto, each gripping unit comprising a pair of pivotal inner and outer locking arms pivotally mounted on the respective primary arm and movable toward each other for gripping the respective end of the reeling drum, each pair of inner and outer locking arms being pivotal about a common gripping unit axis on the respective primary arm so as to form a gripping unit that is pivotable about said gripping unit axis, the gripping units having support surfaces that support at least part of the weight of the reeling drum and the paper reel formed thereon; and controlling a nip load between the paper reel and the surface winding device by controlling pivotal movement of the gripping units relative to the primary arms.

16. The method of claim 15, wherein controlling the nip load comprises pivotally moving one of the locking arms relative to the respective primary arm, and fixing the other locking arm relative to the one locking arm such that the locking arms pivot as a unit relative to the primary arm.

17. The method of claim 15, wherein controlling the nip load comprises detecting a position of the primary arms relative to the surface winding device, and controlling pivotal movement of the gripping units as a function of the detected position of the primary arms.

18. The method of claim 17, wherein the reeling drum in the upper position is positioned relative to the surface winding device such that at least part of the weight of the reeling drum is available to bear on the surface winding device, and wherein the gripping units of the primary arms are operated in an unloading mode when the reeling drum is in the upper position wherein the gripping units are moved to unload at least part of the weight of the reeling drum from the surface winding drum.

19. The method of claim 18, wherein the reeling drum in the lower position is positioned relative to the surface winding device such that the weight of the reeling drum and the paper reel formed thereon acts substantially parallel to the outer surface of the surface winding device and thus does not substantially contribute toward the nip load, and wherein the gripping units are operated in a loading mode when the reeling drum is in the lower position wherein the gripping units are moved so as to urge the paper reel against the surface winding device.

20. The method of claim 19, wherein the control of the gripping units is switched from the unloading mode to the loading mode at a position between said upper and lower positions of the reeling drum.

* * * * *